US012808170B2

(12) United States Patent
Ward et al.

(10) Patent No.: US 12,808,170 B2
(45) Date of Patent: Nov. 24, 2026

(54) WASTE DISPOSER MOTOR BEARING SYSTEM AND METHOD

(71) Applicant: INSINKERATOR LLC, Benton Harbor, MI (US)

(72) Inventors: Jeffrey S. Ward, Kenosha, WI (US); Kelly T. Gamble, Waterford, WI (US); Ronald Rowley, Mount Pleasant, WI (US)

(73) Assignee: INSINKERATOR LLC, Benton Harbor, MI (US)

( * ) Notice: Subject to any disclaimer, the term of this patent is extended or adjusted under 35 U.S.C. 154(b) by 259 days.

(21) Appl. No.: 18/819,586

(22) Filed: Aug. 29, 2024

(65) Prior Publication Data

US 2025/0075481 A1 Mar. 6, 2025

Related U.S. Application Data

(60) Provisional application No. 63/536,568, filed on Sep. 5, 2023.

(51) Int. Cl.
*E03C 1/266* (2006.01)

(52) U.S. Cl.
CPC ..... *E03C 1/2665* (2013.01)

(58) Field of Classification Search
CPC ..... E03C 1/266; E03C 1/2665
USPC ..... 4/661, DIG. 4
See application file for complete search history.

(56) References Cited

U.S. PATENT DOCUMENTS

| | | | | |
|---|---|---|---|---|
| 6,007,006 | A * | 12/1999 | Engel | E03C 1/2665 29/428 |
| 2008/0302891 | A1* | 12/2008 | Anderson | E03C 1/2665 29/428 |
| 2012/0234950 | A1* | 9/2012 | Hammer | H02K 5/1672 310/90 |
| 2015/0115076 | A1* | 4/2015 | Gormley | B02C 18/24 241/36 |
| 2023/0001421 | A1* | 1/2023 | Obermeyer | E03C 1/2665 |
| 2025/0135462 | A1* | 5/2025 | Blanke | B02C 17/20 |

* cited by examiner

*Primary Examiner* — Huyen D Le
(74) *Attorney, Agent, or Firm* — Brooks Kushman, P.C.

(57) ABSTRACT

Waste disposers, such as food waste disposers, motor sections or assemblies as may be employed in such disposers, and related methods, are disclosed herein. In one example embodiment, a food waste disposer includes a housing including an inlet and an outlet, a food conveying section, a motor section, and a grinding section between the food conveying section and the motor section. The motor section includes a motor, a motor shaft, a first bearing, a second bearing, and a frame portion. The frame portion includes each of a cylindrical wall, an annular lip, and a plurality of upwardly-extending tabs. The first bearing is supported by the frame portion within the cylindrical wall, and tips of the upwardly-extending tabs are bent at least partly radially inwardly toward a central axis so that the first bearing is retained by the frame portion by the cylindrical wall, annular lip, and upwardly-extending tabs.

20 Claims, 3 Drawing Sheets

WASTE DISPOSER MOTOR BEARING SYSTEM AND METHOD

FIELD

The present disclosure relates to waste disposers such as food waste disposers and, more particularly, to systems and methods for implementing and supporting motors within such waste disposers.

BACKGROUND

Food waste disposers are used to comminute food scraps into particles small enough to pass through household drain plumbing. A food waste disposer typically includes a primary inlet along the top of the food waste disposer at which the food waste disposer receives water and food scraps from a sink, and also a primary outlet at which food waste and water are output from the food waste disposer. A food waste disposer can be understood as including a food conveying section, a motor section, and a grinding section. The motor section includes a motor, such as an inductive motor or permanent magnet motor, which operates to impart rotational movement to a motor shaft to operate the grinding section.

In general, to save on manufacturing costs, it is desirable to reduce the complexity of the manufacturing process. Also in general, the complexity of the manufacturing process for a given system is directly correlated with the number of components of the system being manufactured. More particularly with respect to food waste disposers, the motor section of a food waste disposer can include a high number of components. Given this to be the case, the motor sections of many conventional food waste disposers may be undesirably complex and costly to implement.

For at least one or more of these reasons, or one or more other reasons, it would therefore be advantageous if improved waste disposers such as improved food waste disposers, and/or improved motor sections or portions of such waste disposers, and/or improved methods of implementation, manufacturing, assembly, and/or operation of such waste disposers or sections or portions thereof, could be developed, so as to address any one or more of the concerns discussed above or to address one or more other concerns or provide one or more benefits.

BRIEF SUMMARY

In at least some example embodiments, the present disclosure relates to a food waste disposer. The food waste disposer includes a housing including a primary inlet and a primary outlet. Also, the food waste disposer includes a food conveying section, a motor section, and a grinding section between the food conveying section and the motor section, where each of the food conveying section, motor section, and grinding section is at least partly supported by or within the housing. Further, the motor section includes a motor, a motor shaft, a first bearing, a second bearing, and a frame portion that least partly extends above or around the motor. Additionally, the frame portion includes each of a first cylindrical wall defining a first central orifice that extends around a central axis, a bottom annular lip extending radially inwardly toward the central axis from a bottom portion of the first cylindrical wall, and a plurality of upwardly-extending tabs extending upward from the first cylindrical wall. Further, the first bearing is supported by the frame portion within the first cylindrical wall, and tips of the upwardly-extending tabs are bent at least partly radially inwardly toward the central axis so that the first bearing is retained by the frame portion by the first cylindrical wall, the bottom annular lip, and the upwardly-extending tabs.

Also, in at least some example embodiments, the present disclosure relates to a method of assembling a motor section of a food waste disposer. The method includes forming a frame portion for the motor section, where the frame portion includes each of an annular top surface extending outward from a central axis toward an outer rim and having a radially inward edge portion defining a first central orifice about the central axis, a radially inwardly extending annular shelf, a first cylindrical wall that extends axially downward from the radially inward edge portion of the annular top surface to the radially inwardly extending annular shelf, and a second cylindrical wall that extends axially downward from an annular ridge provided at a radially inward portion of the radially inwardly extending annular shelf. Further, the frame portion also includes a plurality of upwardly-extending tabs extending upward from the second cylindrical wall. Additionally, the method includes placing a bearing within a second central orifice defined by the second cylindrical wall so that the bearing is supported by the frame portion, deforming at least some portions of the upwardly-extending tabs in a radially-inward manner toward the central axis so that the bearing is captured within the frame portion.

Additionally, in at least some further example embodiments, the present disclosure relates to a motor assembly. The motor assembly includes a motor, a motor shaft, a first bearing, a second bearing, and a frame portion that least partly extends above or around the motor. The frame portion includes each of a first cylindrical wall defining a first central orifice that extends around a central axis, a bottom annular lip extending radially inwardly toward the central axis from a bottom portion of the first cylindrical wall, and a plurality of upwardly-extending tabs extending upward from the first cylindrical wall. Additionally, the first bearing is supported by the frame portion within the first cylindrical wall, and tips of the upwardly-extending tabs are bent at least partly radially inwardly toward the central axis so that the first bearing is retained by the frame portion by the first cylindrical wall, the bottom annular lip, and the upwardly-extending tabs.

BRIEF DESCRIPTION OF THE DRAWINGS

Embodiments of waste disposers such as food waste disposers (or systems including waste disposers), motor sections or portions of such waste disposers, and/or related methods, are disclosed with reference to the accompanying drawings and are for illustrative purposes only. The systems and methods encompassed herein are not limited in their applications to the details of construction, arrangements of components, or other aspects or features illustrated in the drawings, but rather such systems and methods encompassed herein include other embodiments or are capable of being practiced or carried out in other various ways. Like reference numerals are used to indicate like components. In the drawings.

DETAILED DESCRIPTION

Figure 1:
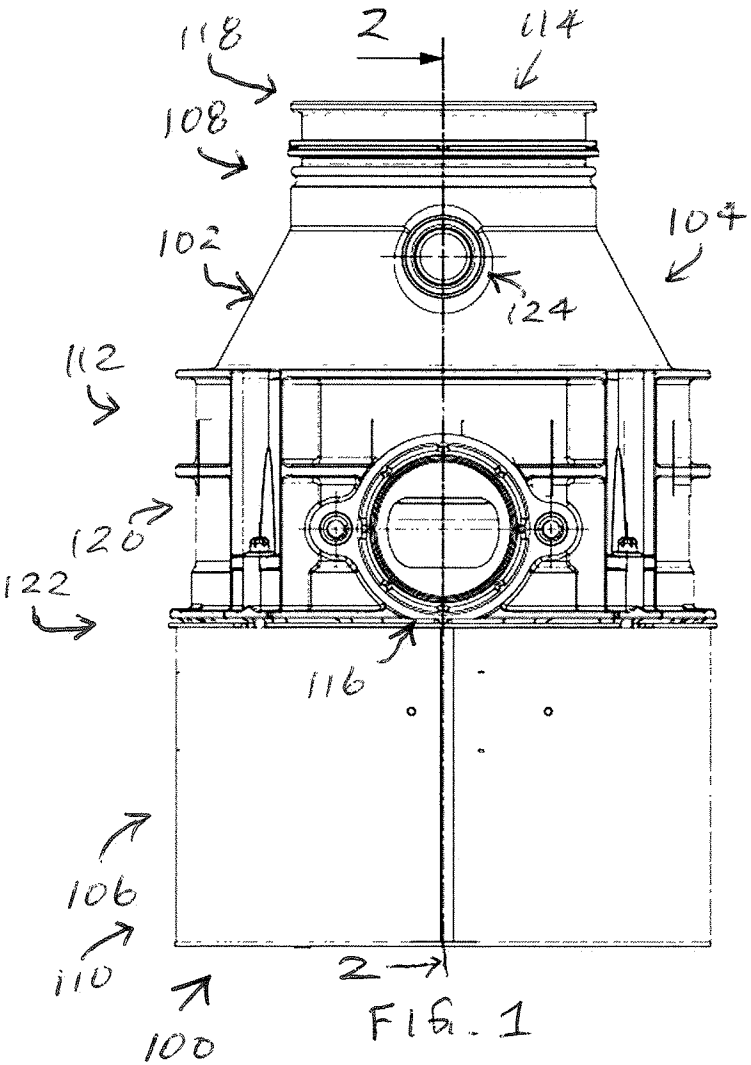
FIG. 1 is a front perspective view of a food waste disposer that includes an upper end frame (UEF) and an upper motor bearing supported by stakes formed within the UEF, in accordance with an example embodiment.

Referring to FIG. 1, a front perspective view of a food waste disposer 100 is shown. The food waste disposer 100 includes a housing 102 having a top housing portion (or enclosure) 104 and a bottom housing portion 106. Also, the food waste disposer 100 can be understood as including a food conveying section 108, a motor section 110, and a grinding section 112, each of which is supported or arranged at least indirectly by or within the housing 102. The food conveying section 108 is generally positioned at a region at or near the top of the food waste disposer 100, within the enclosure 104, and the motor section 110 is generally positioned at a location corresponding to, and within, the bottom housing portion 106. The grinding section 112 is disposed, within the housing (e.g., within the enclosure 104 as shown) between the food conveying section 108 and the motor section 110.

Further as shown, the food waste disposer 100 includes a primary input port or inlet 114 and a primary output port or outlet 116. The primary inlet 114 is positioned along or proximate to a top end 118 of the food waste disposer 100, and is configured to receive water and food scraps from a sink (not shown) to which the food waste disposer is mounted during operation of the food waste disposer. The primary outlet 116 is formed along a first sidewall portion 120 of the enclosure 104, proximate a junction 122 between the enclosure 104 and the bottom housing portion 106, and is configured to allow for food waste and water to pass from the grinding section 112 out from the food waste disposer 100 during operation. The food waste disposer 100 also includes a dishwasher inlet 124 that is an auxiliary port of the food waste disposer and that also is formed along, and as part of, the first sidewall portion 120.

Figure 2:
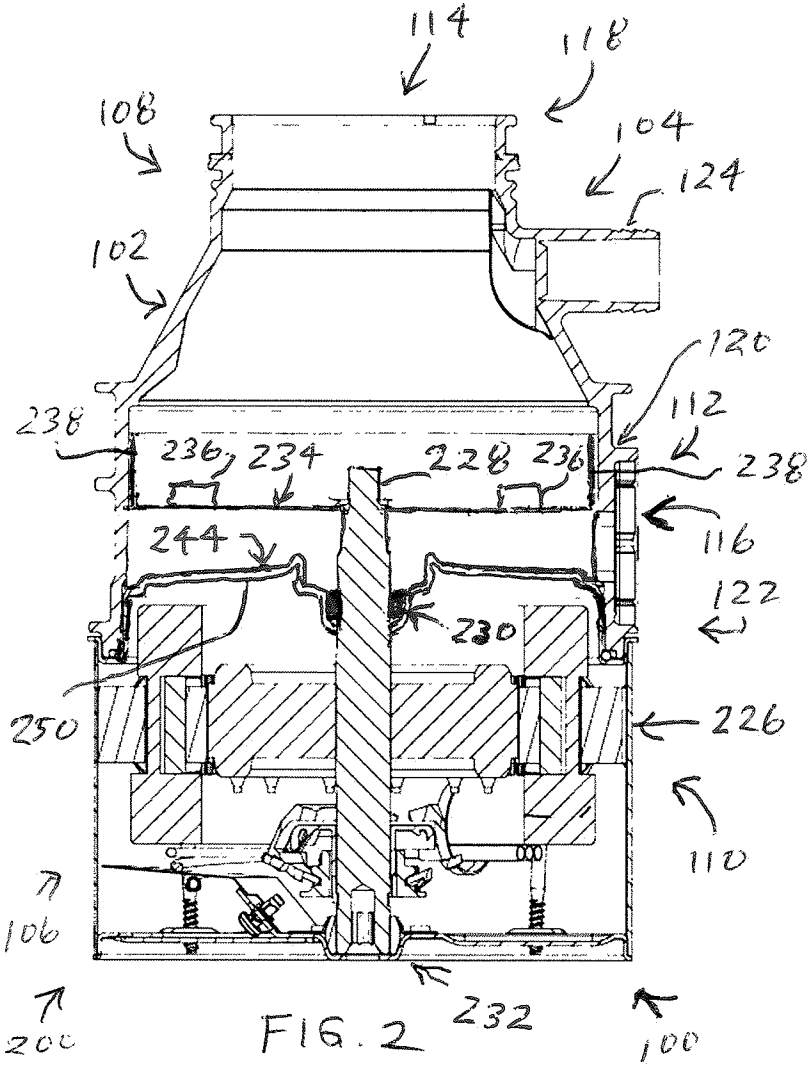
FIG. 2 is a cross-sectional view of the food waste disposer of FIG. 1, taken along a line 2-2 of FIG. 1, which reveals the UEF and upper motor bearing of the food waste disposer.

Referring to FIG. 2, a cross-sectional view 200 of the food waste disposer 100 of FIG. 1, taken along a line 2-2 of FIG. 1, reveals internal components of the food waste disposer in more detail. In particular, as shown in FIG. 2, the motor section 110 includes a motor 226 and a motor shaft 228. In the present example embodiment, the motor 226 is an inductive motor and, in alternate embodiments, the motor can take other forms such as that of a permanent magnet motor. The motor 226 operates to impart rotational movement to the motor shaft 228 to operate the grinding section 112. In the present example embodiment, the motor 226 is supported (at least indirectly) in relation to the housing by a lower motor bearing 232 and an upper motor bearing 230 of the motor section 110.

Further, the grinding section 112 in the present embodiment employs a rotating plate 234, lugs 236, and a stationary shredder ring 238. More particularly, the stationary shredder ring 238 generally takes the form of a cylindrical wall that is supported (at least indirectly) and fixed in position relative to the housing 102. The stationary shredder ring 238 circumferentially surrounds, and generally extends upward from the outer circumference of, the rotating plate 234. The rotating plate 234 is coupled to the motor shaft 228 of the motor section 110 so as to rotate in response to rotation of the motor 226, and the lugs 236 mounted on the rotating plate rotate along with rotation of the rotating plate. Centrifugal forces associated with rotation of the rotating plate 234, along with forces imparted by the lugs 236, tend to cause food scraps to be directed or projected radially outward toward the stationary shredder ring 238.

It should be appreciated that, upon impacting and contacting teeth (not shown) formed along the stationary shredder ring 238, food scraps (not shown) received into the food waste disposer 100 via the primary inlet 114 are comminuted into particles of the desired small size. The particles then pass through gaps (not shown) between the teeth (not shown) of the stationary shredder ring 238. In the present embodiment, after passing through the gaps, the particles (and associated water or other fluids) proceed downward toward an upper surface 244 of an upper end frame (UEF) 250 of the motor section 110, and further proceed circumferentially and radially outward so as to reach the primary outlet 116, by which those particles (and associated water or other fluids) exit the food waste disposer 100. As described further below, among other things, in the present embodiment the UEF 250 is a top enclosure of the motor 226 and serves to support the upper motor bearing 230.

Figure 3:
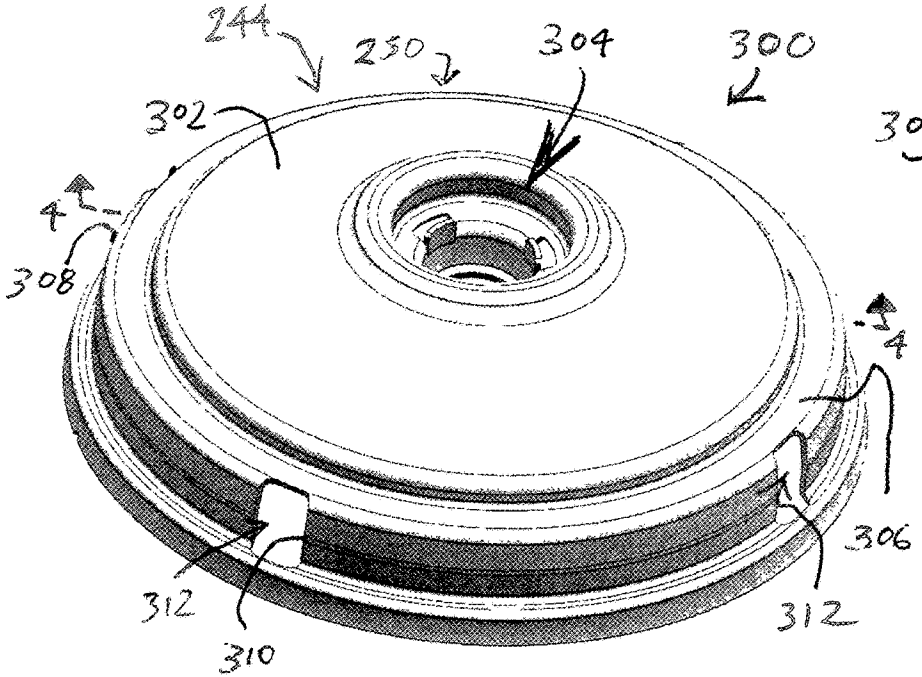
FIG. 3 is a front perspective view of the UEF of the food waste disposer of FIG. 1 and FIG. 2, separate from other portions of the food waste disposer, showing how the UEF would look at a first time prior to when the upper motor bearing has been positioned within the UEF.

Turning to FIG. 3, a front perspective view 300 is provided of the UEF 250 of FIG. 1, when it is separate from other portions of the food waste disposer 100. FIG. 3 particularly shows the UEF 250 when the UEF has a pre-installation status at a first time, prior to when the upper motor bearing 230 is implemented in the food waste disposer 100. As illustrated, the UEF 250 generally takes the form of a circular lid having a primary, substantially-flat annular top surface 302 extending outward from a first central orifice (or depression) 304 toward an outer rim 306 having an outer circumference 308. The upper surface 244 of the UEF 250 can be considered to be formed by the substantially-flat annular top surface 302 and the top surface of the outer rim 306. Further as shown, a cylindrical lip 310 extends downward from the outer circumference 308, and several orifices 312 are formed within the cylindrical lip.

Figure 4:
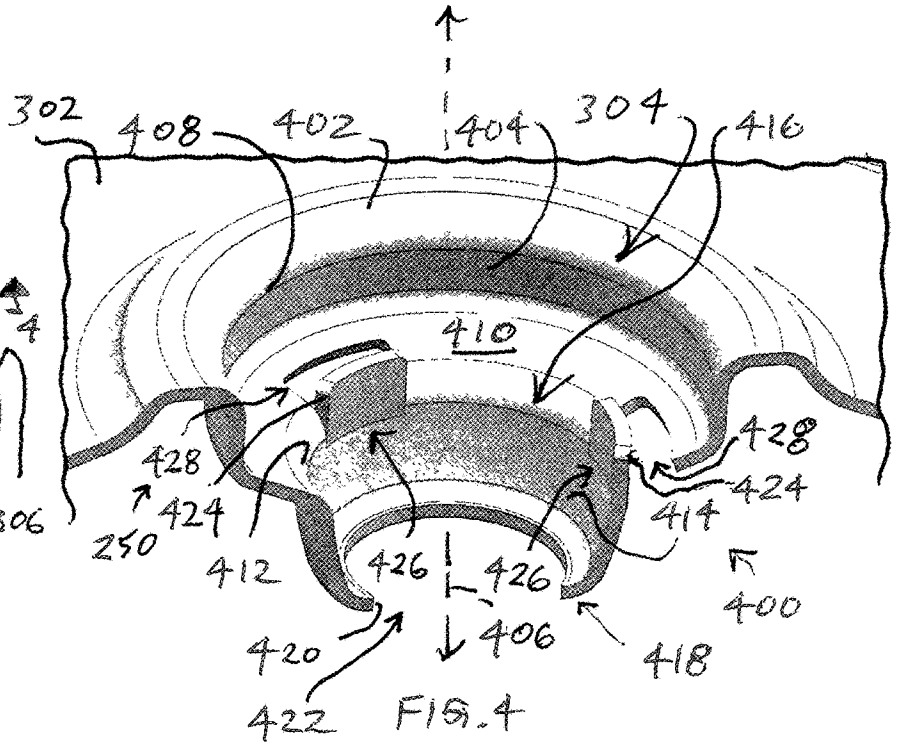
FIG. 4 is a cross-sectional view of a cutaway portion of the UEF at the first time as shown in FIG. 3, taken along a line 4-4 of FIG. 3.

Further, referring to FIG. 4, a cross-sectional view 400 is provided of a cutaway portion of the UEF 250 taken along a line 4-4 of FIG. 3, where the UEF again (as with FIG. 3) has the pre-installation status at the first time (prior to implementation of the upper motor bearing 230). The additional cross-sectional view 400 further reveals various features of the UEF 250 at or around the first central orifice 304. More particularly, it can be seen from FIG. 4 that the substantially-flat annular top surface 302 includes a raised annular lip 402 that defines the radially innermost extent of that substantially-flat annular top surface and that circumferentially extends around and defines the first central orifice 304. Further, a first cylindrical wall 404 extends axially downward, parallel to a central axis 406, from a radially inward edge 408 of the raised annular lip 402 of the substantially-flat annular top surface 302. The first cylindrical wall 404 extends downward to a radially inwardly extending annular shelf 410 that is vertically beneath the substantially-flat annular top surface 302.

The radially inwardly extending annular shelf 410 extends from the first cylindrical wall 404, toward the central axis 406, to an annular ridge 412. As the radially inwardly extending annular shelf 410 extends toward the annular ridge 412, that shelf also extends somewhat downwardly (away from the raised annular lip 402). Further, at the annular ridge 412, the radially inwardly extending annular shelf 410 transitions to become a second cylindrical wall 414. The second cylindrical wall 414 extends axially downward from the annular ridge 412 (also away from the raised annular lip 402), in a manner that is substantially parallel to the central axis 406, and defines a second central orifice 416 that is smaller in diameter than the first central orifice 304.

As illustrated, the second cylindrical wall 414 does not take the exact form of a cylinder, but rather has an aspherical contour such that the diameter of the second cylindrical wall varies somewhat as one proceeds along the second cylindrical wall in a direction substantially parallel to the central axis 406. In particular, as one proceeds along the second cylindrical wall 414 from the annular ridge 412 downward toward a bottom annular edge portion 418 of the second cylindrical wall, the diameter of the second cylindrical wall becomes smaller as one approaches the bottom edge portion, such that the UEF 250 and particularly the second cylindrical wall thereof forms an aspherical bearing pocket. Further, a radially inwardly extending annular bottom lip 420 is additionally formed at the bottom edge portion 418 of the second cylindrical wall 414. The annular bottom lip 420 is integrally formed with, and extends radially inwardly from, the second cylindrical wall 414 toward the central axis 406 and defines a third central orifice 422. Thus, in the present embodiment, the first central orifice 304 has a first diameter that is larger than a second diameter of the second central orifice 416, and the second diameter of the second central orifice is larger than a third diameter of the third central orifice 422.

Further with respect to FIG. 4 (and also as visible in FIG. 3), the UEF 250 includes a plurality of upwardly-extending stakes or tabs 424 that particularly extend upward from a plurality of locations 426 along the annular ridge 412 at the top of the second cylindrical wall 414. In the present example, the plurality of upwardly-extending tabs 424 includes three of the upwardly-extending tabs, two of which are visible in FIG. 4 and FIG. 3 (with the third being missing from the cross-sectional view provided in FIG. 4 and being obstructed by a portion of the substantially-flat annular top surface 302 of FIG. 3). The upwardly-extending tabs 424 of each of the neighboring pairs of the three upwardly-extending tabs (of the plurality of upwardly-extending tabs) in the present embodiment are spaced (or spaced substantially) 120 degrees apart from one another about the annular ridge 412 (and about the second central orifice 416). In the present embodiment, the upwardly-extending tabs 424 are formed from cutout portions of the radially inwardly extending annular shelf 410 that have been bent upward to form the tabs, such that there are a plurality of orifices 428 within that annular shelf at the locations from which those upwardly-extending tabs were cut out.

Thus, the upwardly-extending tabs 424 are integrally formed with annular ridge 412 and with the UEF 250. Although characterized as upwardly-extending, the upwardly-extending tabs can be tabs that extend only slightly upward on a slant rather than directly vertically upward, and in some embodiments need not be upwardly-extending when initially formed (rather, in some such embodiments, the tabs can simply be defined tab structures that are at least partly distinct from the annular shelf 410 or other portion(s) of the UEF 250.

Figure 5:
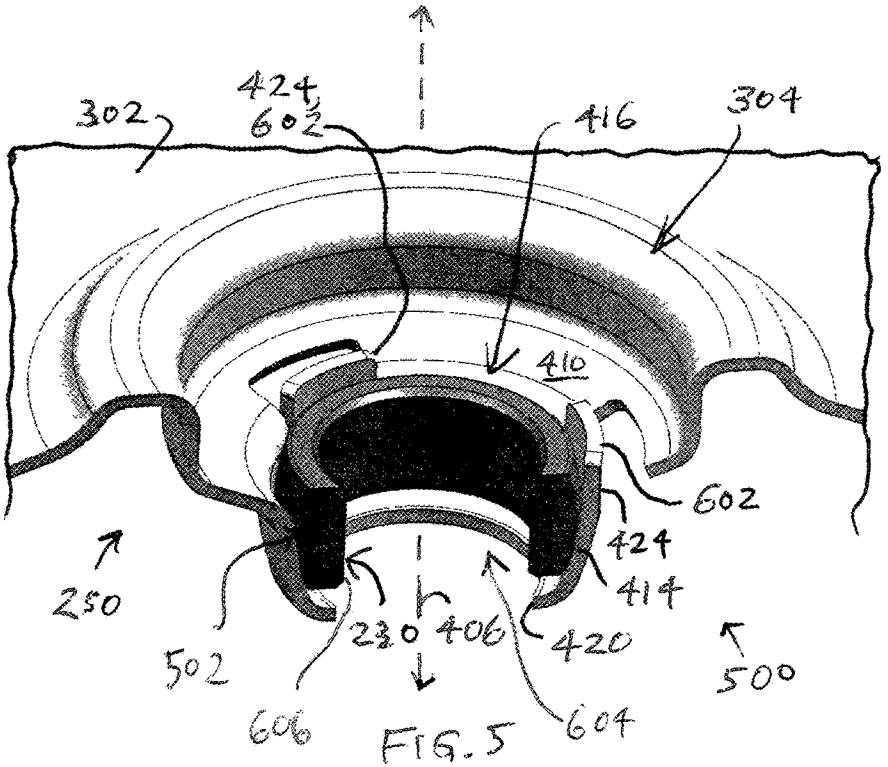
FIG. 5 is a cross-sectional view of a cutaway portion of the UEF of the food waste disposer of FIG. 1 and FIG. 2, which corresponds to the cross-sectional view of the cutaway portion of the UEF shown in FIG. 4 in terms of being a view taken along a line corresponding to the line 4-4 of FIG. 3, in combination with the upper motor bearing of the food waste disposer of FIG. 1 and FIG. 2, at a second time in which the upper motor bearing is initially positioned within the UEF so as to be supported by the UEF.

Turning to FIG. 5, a further cross-sectional view 500 is provided showing a cutaway portion of the UEF 250 taken along a line corresponding to the line 4-4 of FIG. 3. However, in contrast to the cross-sectional view 400 of FIG. 4, the cross-sectional view 500 shows the cutaway portion of the UEF 250 in combination with the upper motor bearing 230 of FIG. 1, at a second time in which that upper motor bearing is initially positioned within the UEF so as to be supported by, but not fully retained in, the UEF. From this view, it can be appreciated that the upper motor bearing 230 generally is situated within the second central orifice 416, within the second cylindrical wall 414, and resting upon the radially inwardly extending annular bottom lip 420 (or at least the junction between that lip and the second cylindrical wall). It will be appreciated that an outer cylindrical surface 502 of the upper motor bearing 230 generally rests in contact with the second cylindrical wall 414. More particularly, the upper motor bearing 230 in the present embodiment is a spherical (or at least partly-spherical) bearing such that the outer cylindrical surface 502 has an outer contour that substantially corresponds to the aspherical contour of the second cylindrical wall 414. Although supported by the UEF 250, it should be appreciated that the upper motor bearing 230 is still not fully retained in position relative to the UEF insofar as the upper motor bearing 230 can be removed from the UEF by removing it axially upward, away from the radially inwardly extending annular bottom lip 420, out from the second central orifice 416, and past the upwardly-extending tabs 424.

Figure 6:
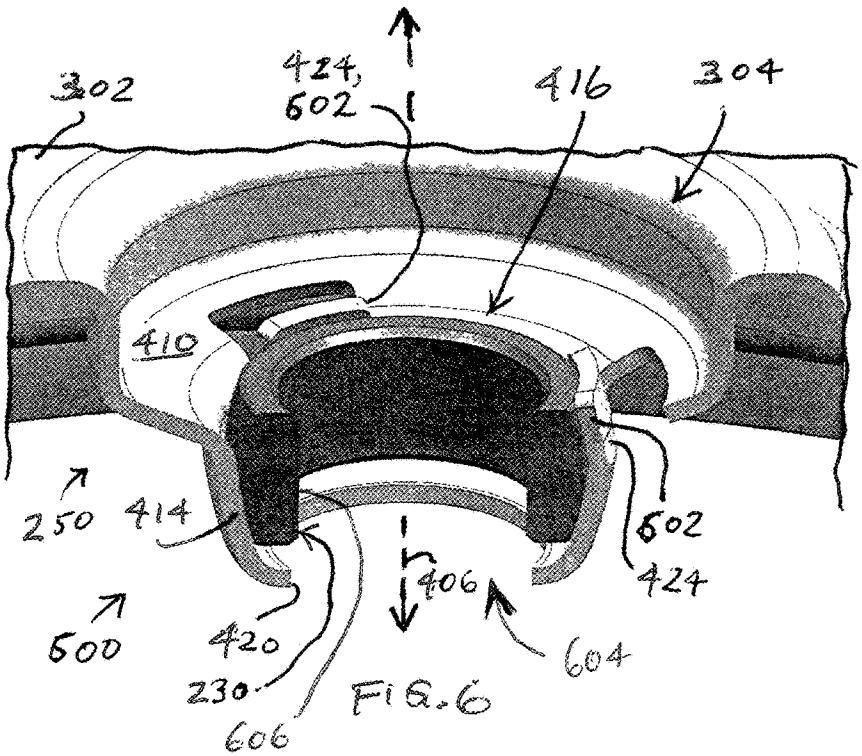
FIG. 6 is an additional cross-sectional view of the cutaway portion of the UEF of the food waste disposer of FIG. 1 and FIG. 2, which corresponds to the cross-sectional views of the cutaway portions of the UEF shown in FIG. 4 and FIG. 5 in terms of being a view taken along a line corresponding to the line 4-4 of FIG. 3, in combination with the upper motor bearing of the food waste disposer of FIG. 1, FIG. 2, and FIG. 5, at a third time in which stakes of the UEF have been modified so as to retain the upper motor bearing.

Referring to FIG. 6, an additional cross-sectional view 600 is provided showing a cutaway portion of the UEF 250 taken along a line corresponding to the line 4-4 of FIG. 3. In contrast to the cross-sectional view 500 of FIG. 4, the cross-sectional view 600 shows the cutaway portion of the UEF 250, in combination with the upper motor bearing 230 of FIG. 2 and FIG. 5, at a third time (rather than at the second time as represented by FIG. 4). At the third time as represented by FIG. 6, the upper motor bearing 230 is both supported by, and retained in relation to, the UEF 250. More particularly, it can be seen from a comparison of FIG. 5 relative to FIG. 6 that, at the third time as represented by FIG. 6, the upwardly-extending tabs 424, and particularly upper tips 602 thereof, are bent radially inwardly toward the central axis 406 by comparison with the positions of those tabs (and the upper tips thereof) at the second time as represented by FIG. 5.

Due to the bent posture of the upwardly-extending tabs 424 and the upper tips 602 thereof, the upwardly-extending tabs and upper tips thereof extend over portions of the upper motor bearing 230. Consequently, the upper motor bearing 230 is physically captured and retained, or staked, in place relative to the UEF 250 by the UEF, and particularly by the upwardly-extending tabs 424 and upper tips 602 thereof in combination with the radially inwardly extending annular bottom lip 420 and second cylindrical wall 414. Although physically captured and retained in place relative to the UEF 250, it should be appreciated that the upper motor bearing 230 is still capable of limited movement within and relative to the UEF 250, including rotational movement about the central axis 406 and possibly some limited axial movement upward or downward along the central axis.

Further, it should be appreciated from FIG. 2 that, after the upper motor bearing 230 has been fully installed relative to the UEF 250 as represented by FIG. 6, the motor section 110 including the motor 226 can be fully assembled and also the food waste disposer 100 including the motor section 110 can be fully assembled and operated. When the motor section 110 is fully assembled, the motor shaft 228 extends through a central bearing orifice 604 of the upper motor bearing 230. Given this arrangement, an inner annular wall 606 of the upper motor bearing 230 serves to support the motor shaft 228 (and particularly serves to keep the motor shaft axially aligned with the central axis 406), and the motor shaft can extend and be coupled to the rotating plate 234 of the grinding section 112 as described above. In at least some embodiments or circumstances, the motor shaft 228 can rotate relative to the upper motor bearing 230 and/or experience limited movement within and relative to the upper motor bearing.

In this manner, the upper motor bearing 230, as supported by and retained within the UEF 250, is able to support and guide movement of the motor shaft 228 during operation of the motor 226. More generally, the upper motor bearing 230 as supported by the UEF 250, in combination with the lower motor bearing 232, are configured to allow for the motor shaft 228 of the motor 226 to rotate relative to other portions of the food waste disposer 100 (such as the housing 102) and to cause movement within the food waste disposer of other components such as the rotating plate 234 (and the lugs 236 supported thereon) of the grinding section 112.

Notwithstanding the description provided above, the present disclosure encompasses numerous additional or alternate embodiments in addition to or differing from what is described above. For example, the UEF 250 can have one or more physical or structural features that are in addition to or different from one or more of the physical or structural features described above. Further for example, in one alternate embodiment, the UEF 250 does not include the raised annular lip 402. Also for example, although there are three of the upwardly-extending tabs of the plurality of upwardly-extending tabs 424 that are spaced apart from one another by 120 (or substantially 120) degrees about the annular ridge 412 in the present embodiment, the present disclosure also encompasses alternate embodiments in which the plurality of upwardly-extending tabs includes other numbers of tabs (e.g., four or five tabs) and/or in which the tabs of the plurality of upwardly-extending tabs are spaced apart from one another by other amounts or in other manners, including manners in which the spacing between different pairs of the tabs is not consistent among different pairs of the tabs.

Further for example, although at least some embodiments encompassed herein relate to an UEF that is configured to support an upper motor bearing that is intended to support a motor shaft of a motor section or assembly that in turn is coupled to a rotating plate of a food waste disposer, the present disclosure also encompasses numerous other embodiments. For example, the present disclosure also encompasses embodiments in which the motor bearing that is supported is another motor bearing, such as a lower motor bearing, and/or embodiments in which the structure that supports or retains the bearing is another type of structural frame component associated with a motor section or assembly other than an UEF. Additionally for example, the present disclosure further encompasses embodiments in which the motor section including the motor bearing is implemented in another type of waste disposer other than a food waste disposer, and/or embodiments in which the motor section including the motor bearing is implemented in another type of device or system other than a waste disposer.

One or more of the embodiments encompassed herein can be advantageous in one or more respects. In particular, in at least some embodiments encompassed herein, the upper motor bearing is staked into the UEF (or the upper motor frame or a portion thereof) and the bearing is staked with material of the UEF. Given such an arrangement, no bearing retainer is employed at the location of the upper motor bearing for implementing the upper motor bearing. By avoiding the use of a bearing retainer at the location of the upper motor bearing, one less part is employed in assembling the motor section or assembly and the overall food waste disposer by comparison with the assembling of at least some conventional embodiments. The upper motor bearing can be formed simply in three steps by (1) initially stamping an UEF component (e.g., a single UEF component) including an aspherical bearing pocket surrounded by three formed tabs, (2) during the production assembly process, placing a spherical bearing in the aspherical bearing pocket, and (3) deforming the three tabs to secure or capture the bearing in the pocket formed within the UEF.

It is specifically intended that the present invention not be limited to the embodiments and illustrations contained herein, but include modified forms of those embodiments including portions of the embodiments and combinations of elements of different embodiments as come within the scope of the following claims.

We claim:

1. A food waste disposer comprising:

a housing including a primary inlet and a primary outlet; and a food conveying section, a motor section, and a grinding section between the food conveying section and the motor section, wherein each of the food conveying section, motor section, and grinding section is at least partly supported by or within the housing, wherein the motor section includes a motor, a motor shaft, a first bearing, a second bearing, and a frame portion that least partly extends above or around the motor, wherein the frame portion includes each of a first cylindrical wall defining a first central orifice that extends around a central axis, a bottom annular lip extending radially inwardly toward the central axis from a bottom portion of the first cylindrical wall, and a plurality of upwardly-extending tabs extending upward from the first cylindrical wall, and wherein the first bearing is supported by the frame portion within the first cylindrical wall, and wherein tips of the upwardly-extending tabs are bent at least partly radially inwardly toward the central axis so that the first bearing is retained by the frame portion by the first cylindrical wall, the bottom annular lip, and the upwardly-extending tabs.

2. The food waste disposer of claim 1, wherein at least a first wall portion of the first cylindrical wall as an aspherical contour so that the frame portion includes is configured to serve as an aspherical pocket within which the first bearing is supported.

3. The food waste disposer of claim 2, wherein the first bearing is annular and has an at least partly spherical shape.

4. The food waste disposer of claim 3, wherein the first bearing is retained by the frame portion without any bearing retainer being employed.

5. The food waste disposer of claim 1, wherein the plurality of upwardly-extending tabs include first, second, and third upwardly-extending tabs.

6. The food waste disposer of claim 5, wherein the first, second, and third upwardly-extending tabs are respectively positioned at first, second and third locations, respectively, around the first cylindrical wall.

7. The food waste disposer of claim 6, wherein the first and second locations are substantially 120 degrees apart about the central axis, wherein the second and third locations are substantially 120 degrees apart about the central axis, and wherein the first and third locations are substantially 120 degrees apart about the central axis.

8. The food waste disposer of claim 1, wherein the frame portion is an upper end frame (UEF) that includes each of an annular top surface extending outward from a second central orifice toward an outer rim, a radially inwardly extending annular shelf, and a second cylindrical wall that extends axially downward from a radially inward edge of the annular top surface to the radially inwardly extending annular shelf, and wherein the radially inwardly extending annular shelf extends radially inwardly substantially from the second cylindrical wall to the first cylindrical wall.

9. The food waste disposer of claim 8, wherein the upwardly-extending tabs are formed as cutout portions from the radially inwardly extending annular shelf.

10. The food waste disposer of claim 9, wherein the annular top surface includes a raised annular lip having a radially inward edge from which extends downwardly the second cylindrical wall, and wherein an annular ridge is located between the radially inwardly extending annular shelf and the first cylindrical wall.

11. A method of assembling a motor section of a food waste disposer, the method comprising:

forming a frame portion for the motor section, wherein the frame portion includes each of an annular top surface extending outward from a central axis toward an outer rim and having a radially inward edge portion defining a first central orifice about the central axis, a radially inwardly extending annular shelf, a first cylindrical wall that extends axially downward from the radially inward edge portion of the annular top surface to the radially inwardly extending annular shelf, and a second cylindrical wall that extends axially downward from an annular ridge provided at a radially inward portion of the radially inwardly extending annular shelf, and wherein the frame portion also includes a plurality of upwardly-extending tabs extending upward from the second cylindrical wall;

placing a bearing within a second central orifice defined by the second cylindrical wall so that the bearing is supported by the frame portion; and deforming at least some portions of the upwardly-extending tabs in a radially-inward manner toward the central axis so that the bearing is captured within the frame portion.

12. The method of claim 11, wherein the frame portion additionally includes a bottom annular lip extending radially inwardly toward the central axis from a bottom portion of the second cylindrical wall, and wherein at least a first portion of the frame portion including at least a second portion of the second cylindrical wall forms an aspherical bearing pocket surrounded by the upwardly-extending tabs.

13. The method of claim 12, wherein the plurality of upwardly-extending tabs includes at least three of the upwardly-extending tabs, wherein the bearing is at least partly spherical, and wherein the bearing upon being captured within the frame portion is still movable in at least one aspect relative to the frame portion.

14. The method of claim 11, wherein the forming includes stamping the frame portion and also includes cutting out the upwardly-extending tabs at least partly from the radially inwardly extending annular shelf.

15. A method of assembling the food waste disposer comprising the method of claim 11, and further comprising:

first assembling the motor section including the frame portion, wherein the first assembling includes positioning a motor in relation to the frame portion so that a motor shaft of the motor extends through a further central orifice of the bearing; and additionally assembling the motor section within a housing of the food waste disposer, wherein the additionally assembling includes attaching the motor shaft at least indirectly to a rotating plate of a grinding section of the food waste disposer.

16. A method of operating the food waste disposer assembled by the method of claim 15, wherein the method of operating includes:

actuating the motor of the motor section so as to cause first rotating of the motor shaft, wherein the first rotating of the motor shaft causes additional rotating of the rotating plate of the grinding section relative to the housing, wherein the first rotating of the motor shaft occurs relative to the frame portion as permitted by the bearing captured by the frame portion including the upwardly-extending tabs.

17. A motor assembly comprising:

a motor;

a motor shaft;

a first bearing;

a second bearing; and a frame portion that least partly extends above or around the motor, wherein the frame portion includes each of a first cylindrical wall defining a first central orifice that extends around a central axis, a bottom annular lip extending radially inwardly toward the central axis from a bottom portion of the first cylindrical wall, and a plurality of upwardly-extending tabs extending upward from the first cylindrical wall, and wherein the first bearing is supported by the frame portion within the first cylindrical wall, and wherein tips of the upwardly-extending tabs are bent at least partly radially inwardly toward the central axis so that the first bearing is retained by the frame portion by the first cylindrical wall, the bottom annular lip, and the upwardly-extending tabs.

18. The motor assembly of claim 17, wherein the plurality of upwardly-extending tabs include at least three of the upwardly-extending tabs.

19. A waste disposer comprising the motor assembly of claim 17.

20. The waste disposer of claim 19, wherein the waste disposer is a food waste disposer that includes a grinding section having a rotating plate coupled to the motor shaft of the motor assembly.

* * * * *